US012607429B2

(12) United States Patent
Mallory

(10) Patent No.: US 12,607,429 B2
(45) Date of Patent: Apr. 21, 2026

(54) BOW ATTACHMENT WEIGHT REST

(71) Applicant: Cole Mallory, Haslett, MI (US)

(72) Inventor: Cole Mallory, Haslett, MI (US)

( * ) Notice: Subject to any disclaimer, the term of this patent is extended or adjusted under 35 U.S.C. 154(b) by 157 days.

(21) Appl. No.: 18/415,041

(22) Filed: Jan. 17, 2024

(65) Prior Publication Data

US 2024/0240910 A1 Jul. 18, 2024

Related U.S. Application Data

(60) Provisional application No. 63/480,288, filed on Jan. 17, 2023.

(51) Int. Cl.
*F41B 5/14* (2006.01)

(52) U.S. Cl.
CPC ..... *F41B 5/148* (2013.01); *F41B 5/1453* (2013.01)

(58) Field of Classification Search
CPC ..... F41B 5/148; F41B 5/1426; F41B 5/1449; F41B 5/1453; F41B 5/1461; F45F 5/00; F45F 5/021; A45F 2005/1006; A01M 31/02; F41A 23/18
USPC ..... 124/86, 88
See application file for complete search history.

(56) References Cited

U.S. PATENT DOCUMENTS 1,654,027 A * 12/1927 Westerfors ..... A47B 23/007 248/447.2
3,514,066 A * 5/1970 Henley ..... A47B 23/02 248/463
4,363,459 A * 12/1982 Holzer ..... E06B 9/323 248/265
4,467,991 A * 8/1984 Bailes ..... A47B 23/02 248/447.2
4,674,472 A 6/1987 Leahy
4,714,071 A * 12/1987 Saunders ..... F41B 5/14 124/88
4,836,177 A * 6/1989 Williams ..... F41B 5/14 124/88
5,239,976 A * 8/1993 Specht ..... F41B 5/1461 224/916
5,697,537 A * 12/1997 Bowlsby ..... F41C 33/007 224/678
6,745,756 B1 * 6/2004 Achkar ..... F41B 5/1461 124/88
7,275,528 B1 * 10/2007 Daigler ..... F41B 5/143 124/25.7
8,485,402 B2 7/2013 Smith
8,839,774 B1 * 9/2014 Torbett ..... F41B 5/1453 124/88
11,466,956 B2 10/2022 Leahy
11,815,327 B2 11/2023 Ochs
2005/0012004 A1 * 1/2005 Thompson ..... B63B 17/02 248/214

(Continued)

*Primary Examiner* — John E Simms, Jr.
(74) *Attorney, Agent, or Firm* — Andrew G. Martin

(57) ABSTRACT

A weight support apparatus and method of use for attachment to an archery bow. The apparatus includes a base having two wings that extend laterally out to support the weight of a bow. Arms are positioned perpendicularly on the base forming a gap between opposing arms to receive a portion of a bow. One or more arms are provided to mount the apparatus on a bow by introducing a portion of the bow between the arms. A through bolt is also provided that secures the apparatus to the bow by tightening the arms against the bow.

12 Claims, 7 Drawing Sheets

(56) References Cited

U.S. PATENT DOCUMENTS

| | | | | |
|---|---|---|---|---|
| 2005/0284995 | A1* | 12/2005 | Hutter, III | F16B 37/044 248/235 |
| 2007/0193571 | A1* | 8/2007 | Moss | F41B 5/14 124/88 |
| 2013/0233292 | A1* | 9/2013 | Gardner | F41B 5/1426 124/25.6 |
| 2015/0115114 | A1* | 4/2015 | White | F41A 23/18 248/201 |
| 2015/0219417 | A1* | 8/2015 | Billings | F41B 5/1461 224/576 |
| 2016/0054090 | A1* | 2/2016 | Nettleton | F41B 5/1453 124/86 |
| 2022/0049923 | A1* | 2/2022 | Popa | F41B 5/1453 |
| 2022/0373292 | A1* | 11/2022 | D'Acquisto | F41B 5/1453 |

* cited by examiner

BOW ATTACHMENT WEIGHT REST

CROSS-REFERENCE TO RELATED APPLICATIONS

This application claims priority to U.S. Provisional Patent Application No. 63/480,288 which was filed on Jan. 17, 2023 and titled "Bow Attachment Weight Rest", the disclosures of which are incorporated herein by reference.

BACKGROUND OF THE INVENTION

The statements in this section merely provide background information related to the present disclosure and may not constitute prior art.

This application relates to an adjustable bow attachment that is compatible across a wide array of typical archery bow designs. The adjustable bow attachment supports much of the weight of the bow and allows the user to rest an archery bow in multiple positions upon a person object or structure.

Archery, including bow hunting, typically involves a modern compound bow. Modern compound bows are sophisticated pieces of equipment that often include fine-tuned components including dampeners, cams, bow string, bow cables, stabilizers, arrow shelfs, and grips. These components are all designed to make the bow easier to use, more precise and more effective. Understandably, a bow is typically held and transported in a protective manner so as to prevent damage to the multitude of sensitive components. This requires a great amount of effort by the user to carry a bow in a protected manner while traversing often rough and wild terrain.

A bow hunter typically relies on stealth and camouflage to conceal themselves from their prey. However, due to the size and weight of the bow, the hunter cannot continuously maintain the bow in a ready position until the hunter is nearly ready to take a shot. As a hunter brings the bow up to aim and load the bow, the movement risks revealing the position of the hunter to the prey and spooking the prey. The more effort it takes to position the bow, the higher the chances of spooking the prey.

Solutions have been attempted to mitigate this problem, such as bow racks within blinds, or slings worn by the hunter. However, these solutions require additional gear that occupies valuable space on the hunter's person or in the hunter's blind. Further, these solutions are often only compatible with specific designs or models of compound bows.

What is needed is a bow weight rest that is simple to use, does not inhibit the natural motion of a user, and is compatible with a wide range of bows.

SUMMARY OF THE INVENTION

The present disclosure provides for weight support apparatus for attachment to an archery bow and a method of use. In an example the apparatus includes: (a) a base comprising a first wing and a second wing, each wing extending laterally away from a centerline of the base; (b) two or more arms comprising: (i) a shoe; (ii) a shoe slot arranged in the middle of the shoe; (iii) a lug portion arranged perpendicular to the shoe and extending out and away from a medial face of the shoe; and (iv) a bolt hole arranged in the middle of said lug portion; wherein the arms are joined by a fastener extending through the two or more bolt holes; (c) a base channel configured to receive the shoes of said arms; and (d) a channel slot arranged at the bottom of the base channel configured to join the two or more arms to the base, wherein, the arms are positioned opposing one another in the channel slot and are slidably attached to the base by a through bolt extending through the shoe slot and channel slot.

In a further example, the present disclosure provides for a weight support apparatus for attachment to an archery bow that includes: (a) a base comprising a first and second wing that extend laterally away from the center of the base; (b) two or more arms integrally formed with the base and arranged symmetrically on the medial side of the base; (c) an attachment point located between the two or more arms on the medial side of the base; (d) a bolt hole arranged on each of the arms that is aligned with a complementary bolt hole on an opposing arm; and (e) a through bolt inserted into the bolt hole on each of the arms wherein the attachment bolt spans the gap between the opposing arms.

In another example, the present disclosure provides for a method of attaching a weight support apparatus to a bow. The method comprises the steps of: (a) providing a bow; (b) attaching the weight support apparatus to the bow by inserting the bow between the two or more arms; (c) positioning the bow to abut against an attachment point of the weight support apparatus; (d) inserting a through bolt though bolt holes arranged on each of said arms; and (e) tightening the through bolt.

In yet a further example, the present disclosure provides for a method of attaching a weight support apparatus to a bow. The method comprises the steps of: (a) providing a bow; (b) attaching the two or more arms to the base of the weight support apparatus by guiding the shoes of the arms into the channel; (c) sliding the shoes along the length of the channel to reach a desired width; (d) fastening the arms by inserting a shoe bolt into the shoe hole and through the channel slot; (e) attaching the weight support apparatus to the bow by inserting the bow between the arms; (f) positioning the bow to abut against the attachment point; (g) inserting a through bolt through the bolt holes on each of the arms; and (h) tightening the through bolt.

Further areas of applicability will become apparent from the description provided herein. It should be understood that the description and specific examples are intended for purposes of illustration only and are not intended to limit the scope of the present disclosure.

Figure 1A:
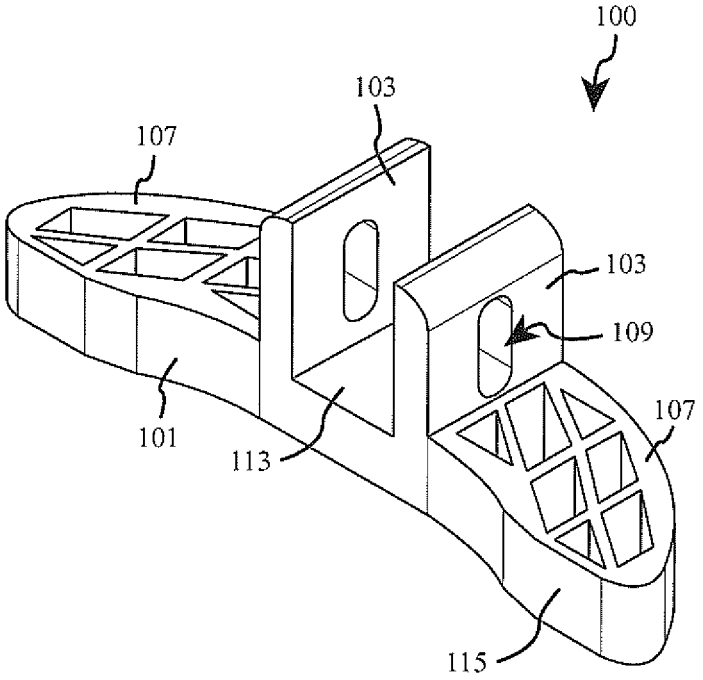
FIG. 1A is a front perspective view of a weight support apparatus for attachment to a bow according to an embodiment of the present disclosure.
Figure 1B:
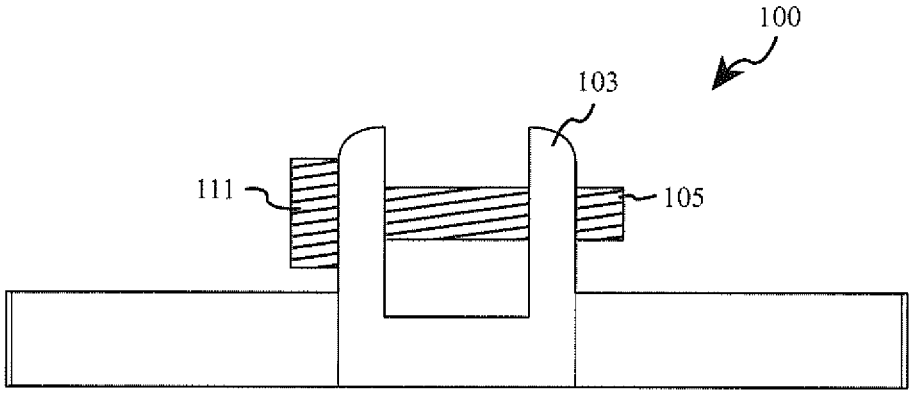
FIG. 1B is a top-down view of the apparatus illustrated in FIG. 1A.

The drawings described herein are for illustration purposes only and are not intended to limit the scope of the present disclosure in any way.

DETAILED DESCRIPTION OF THE INVENTION

The following description is merely exemplary in nature and is not intended to limit the present disclosure, application, or uses. It should be understood that throughout the drawings, corresponding reference numerals indicate like or corresponding parts and features.

Throughout the specification and claims, terms may have nuanced meanings suggested or implied in context beyond an explicitly stated meaning. Likewise, the phrase "in an example" as used herein does not necessarily refer to the same example and the phrase "in another example" as used herein does not necessarily refer to a different example. It is intended merely to illustrate examples of the invention and should be understood that the claimed subject matter includes combinations of example embodiments in whole or in part.

The present disclosure provides for an apparatus, system and method configured to reduce the amount of weight held in the user's hands and relieve some of the physical demands of carrying the full weight of a bow in the user's hands when the bow is not being aimed and shot. The apparatus secures to a bow along the upright section on the main body of a bow. Its purpose is to take the weight of the bow off of a user's hands when the apparatus is rested or balanced on the body of the user or another nearby object. This can be effective to displace the weight of the bow from the user's grip and limit the fatigue felt by the user and allowing the user to maintain a more stable and accurate position when raising the bow into a shooting position. Bows are usually laid in laps or hung on hooks while hunting. However, movement of a hunter reaching for a bow may spook the prey. By resting the weight of the bow on oneself or a nearby object, the user's arm and hands will not be fatigued and the user will be ready when the time comes to take a shot.

Referring now to FIGS. 1-4, the present disclosure provides for an apparatus 100 for attachment to a bow. Apparatus 100 is configured to be removably attached to a bow and is comprised of a base 101, two or more arms 103, and a through bolt 105. Referring to FIGS. 1A-B, in an example, base 101 comprises two wings 107 extending laterally out and away from the centerline of the base 101.

In an example, wings 107 may be planar or curved to ergonomically rest on a supporting structure. A supporting structure may include an item near a user, pants, a belt, or a user's body. The wings 107 are made of a rigid material such as metal or rigid plastic so that apparatus 100 may support the weight of a bow while the in use. In another example, wings 107 may provide a grip region 115 on an outer edge of the wings 107. Grip region 115 increases grip between the apparatus 100 and the chosen mounting site such as a pant or belt of a user. In an example, grip region 115 is formed as a serrated edge. In another example, the grip region 115 is formed as a tacky surface such as silicone.

The two or more arms 103 are arranged on one side of the base 101 and extend perpendicularly out and away from the base 101. The arms 103 are located between the wings 107 of the base 101 and are positioned opposing each other such that an attachment point 113 is formed between the arms 103. In an example, the attachment point 113 between the opposing arms 103 is configured to receive a bow, in particular the riser portion of conventional compound bows.

In an example, each arm 103 defines one or more bolt holes 109 extending perpendicularly through each arm 103. Each bolt hole 109 is positioned in the arms 103 such that a complementary bolt hole 109 is parallel on the opposing arm 103. In an example the bolt holes 109 may be threaded to accept a threaded bolt.

In an example, a through bolt 105 is inserted through two complementary bolt holes 109 such that a single through bolt 105 spans the gap between two opposing arms 103. The through bolt 105 may further include a nut 111 positioned on the opposite end of the head of the through bolt 105. The through bolt 105 is configured to provide compression between the two or more opposing arms 103 by rotating the nut 111 and pressing each end of the through bolt against the abutting face of the arms 103.

A bow riser section (not shown) may be positioned in the gap between the opposing arms 103. The through bolt 105 is positioned in the bolt holes 109 spanning the gap between the arms 103 and is configured to be tightened to provide a compression force between the arms 103 and the bow riser located between the arms 103. Further tightening of the through bolt 105 secures the entire apparatus 100 to the riser of the bow.

In an example, the bolt holes 109 may be shaped as an elongated channel that extends along a length of the arms 103. The elongated bolt hole 109 may be configured to allow for lateral movement of the through bolt 105 along the length of the elongated bolt hole 109. Lateral movement of the through bolt 105 provides for greater compatibility of the apparatus 100 with a larger variety of bow sizes.

Figure 2A:
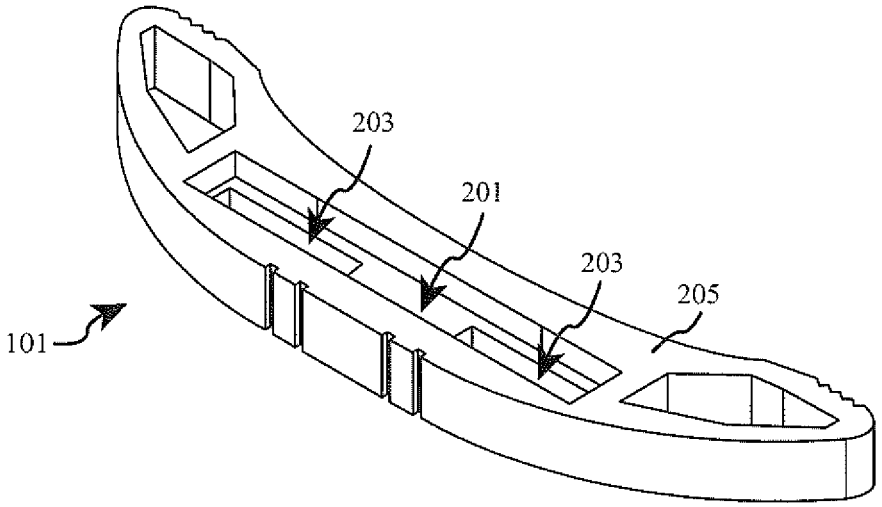
FIG. 2A is a front perspective view of a base of a weight support apparatus for attachment to a bow in accordance with an embodiment of the present disclosure.
Figure 2B:
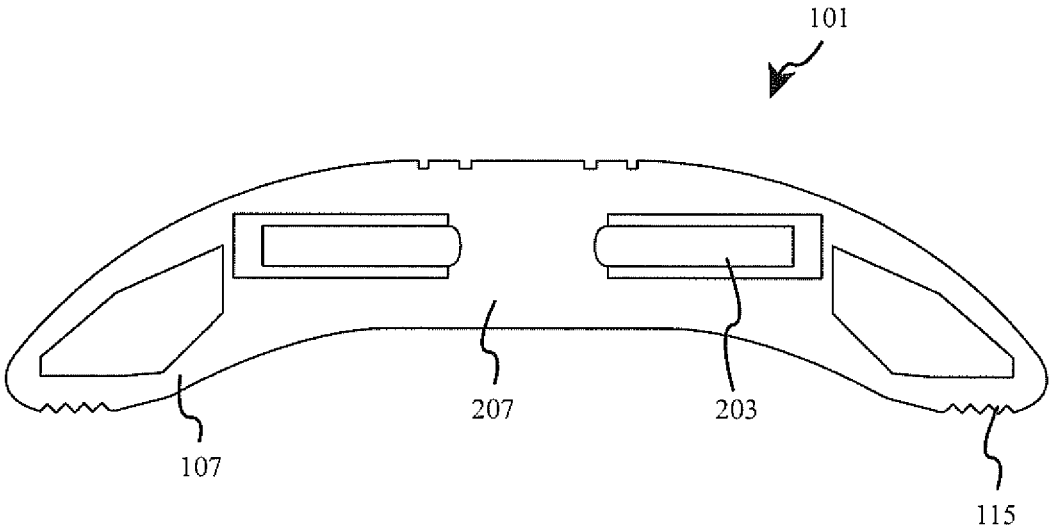
FIG. 2B is a back view of a base illustrated in FIG. 2A.
Figure 3A:
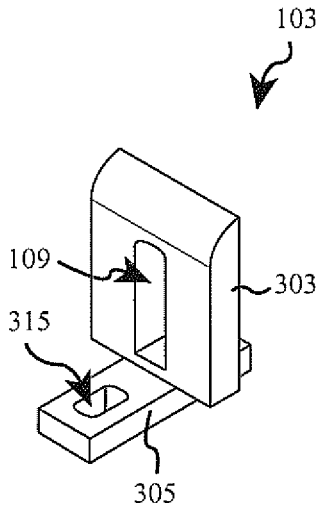
FIG. 3A is a perspective front view of an arm of a weight support apparatus for attachment to a bow according to an embodiment of the present disclosure.
Figure 3B:
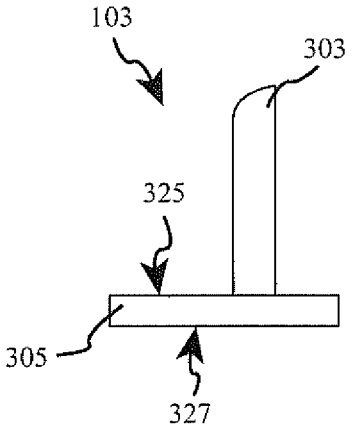
FIG. 3B is a top-down view of an arm illustrated in FIG. 3A.
Figure 4A:
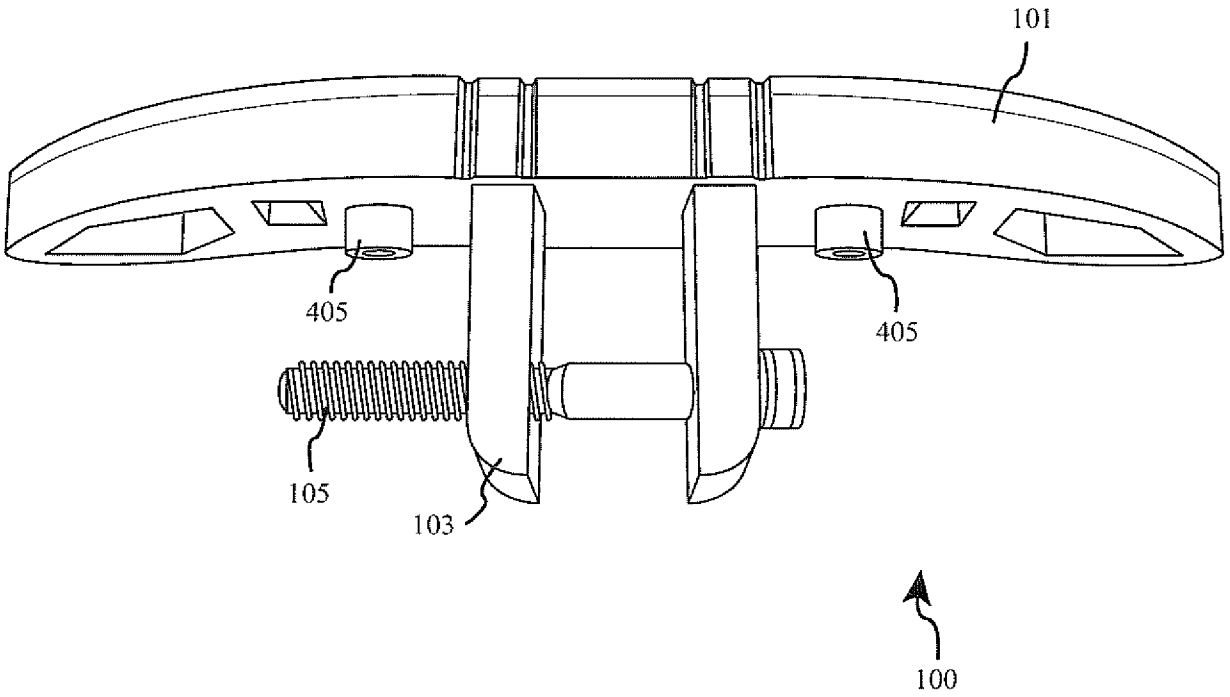
FIG. 4A is a top-down perspective view illustrating an assembled weight support apparatus for attachment to a bow in accordance with an embodiment of the present disclosure.
Figure 4B:
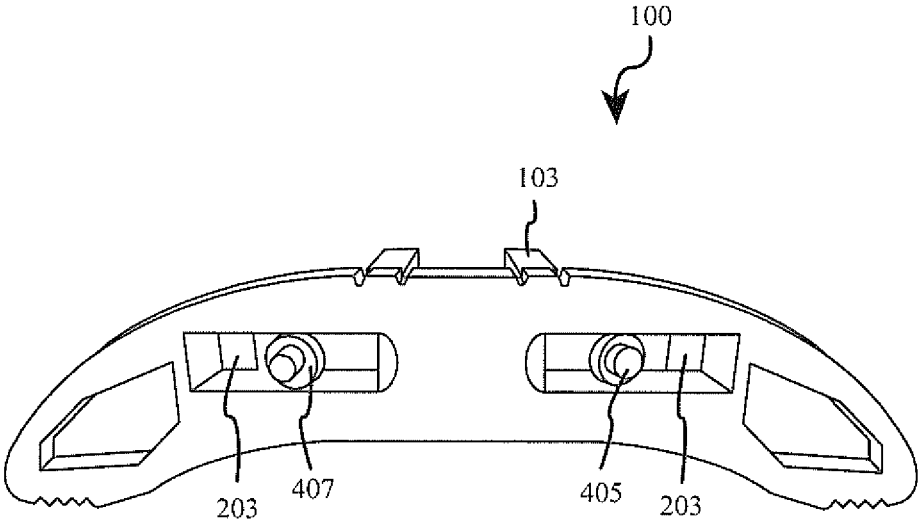
FIG. 4B is a front perspective view illustrating an assembled weight support apparatus of FIG. 4A.

Referring to FIGS. 2A-B, another example of the bow support apparatus 100 is provided comprising the base 101 and two removably attached arms 103. Base 101 includes two wings 107 that extend in laterally opposing directions out and away from the center of the base 101. A channel 201 is provided on a medial face 205 of the base 101. The medial face of the apparatus 100 and its components refers to the side that faces away from a user and toward a bow during operation.

The channel 201 is configured to extend a predetermined depth into the base 101 and extend laterally along the base 101 such that the channel 201 spans the gap between the two wings 107 of the base 101. Within the channel 201, two channel slots 203 are provided. The channel slots 203 are positioned symmetrically to one another in relation to a centerline of said base 101. Channel slots 203 are defined by base 101 and extend from the medial face 205 through the base 101, and out to a lateral face 207 of base 101.

The invention further provides for independent arms 103 that may be removably attached to the base 101. In an example, the apparatus 100 provides two arms 103. Each arm 103 comprises a lug portion 303, a bolt hole 109, a shoe 305, and a shoe slot 315. The arms 103 may be formed in a T-shape or L-shape in which the lug portion 303 and shoe 305 are arranged perpendicular to each other. Lug portion 303 is arranged on a medial face of the shoe 325 and extends out and away from the medial face of the shoe 325. Shoe 305 is configured to fit within channel 201 of base 101. Shoe 305 also defines a shoe slot 315 arranged within the shoe 305 and extending from a lateral face of the shoe 307 to the medial face of the shoe 325.

In an example, the shoes 305 are inserted into the channel 201 such that the shoes 305 are parallel with the medial face of the channel 201 and rest completely within the channel 201. When the shoes 305 are installed in the channel 201, lug portion 303 extends perpendicular out from the channel 201. While the shoes 305 are installed in the channel 201, the arms 103 are slidably positionable along the length of channel 201. The ability to position the arms 103 along the channel 201 allows for the apparatus 100 to accommodate multiple sizes of bow risers. In an example, the shoe 305 is arranged so that the shoe slot 315 is aligned with a channel slot 203.

Channel slot 203 and shoe slot 315 are configured to accept a shoe bolt 405. In an example, shoe bolts 405 are provided to fasten the arms 103 to base 101. Shoe bolt 405 may be inserted through shoe slot 315 and through an aligned channel slot 203. In an example, shoe bolt 405 is secured by a complementary hex nut 407 on the lateral side of the base 101. In another example, shoe bolt 405 is configured as a plastic bolt, such as a thumb screw bolt.

While the arms 103 are secured to base 101, a through bolt 105 may be inserted into and through the bolt hole 109 in the lug portion 303 of one of the arms 103. The through bolt 105 may span the gap formed between the opposing arms 103 and enter a complementary bolt hole 109 on the opposing arm 103.

When assembled, the through bolt 105 compresses opposing arms 103 toward each other by tightening the through bolt 105. In an example, bolt holes 109 are threaded and configured to receive a complementary threaded through bolt 105 such that the through bolt 105 is tightened by rotation of itself. In another example, the through bolt 105 is secured by a hex nut 111. In yet another example, the through bolt 105 is configured as a plastic bolt, such as a thumb screw.

The present disclosure also provides for a method of use of apparatus 100. In an example, the base 101 is mounted to a compound bow riser with medial face 205 of apparatus 100 facing toward a compound bow. The bow is then inserted between the arms 103 such that the bow abuts against the attachment point 113. Once the apparatus 100 is placed in its desired position on the bow, the through bolt 105 is inserted into the bolt holes 109 and fastened to secure the apparatus 100 onto the bow. In an example, the through bolt 105 is slidably positioned along an elongated bolt hole 109 to provide for compatibility with a range of bow sizes.

In yet a further example, another method is provided by the invention wherein the base 101 first attaches to two or more arms 103. The shoes 305 of the arms 103 are inserted into the channel 201. A bow may then be introduced between the arms 103 and the arms 103 may be slidably positioned to adjust to the width of the bow. Once the desired width of the arms 103 is reached, shoe bolts 405 are inserted into and through the shoe slot 315 of each shoe 305 and out through the channel slot 203. Alternatively, the shoes 305 may be mounted on the base 101, and slidably positioned to the width of a bow. The shoe bolts 405 are then tightened to secure the arms to the base 101. The bow is then inserted between the arms 103 such that the bow abuts against the attachment point 113. Once the apparatus 100 is placed in its desired position on the bow, the through bolt 105 is inserted into the bolt holes 109 and fastened to secure the apparatus 100 onto the bow. In an example, the through bolt 105 is slidably positioned along an elongated bolt hole 109 to provide for compatibility with a range of bow sizes. In an example, a further step may be provided by resting wings 107 on a belt, pant waist, or other structure.

While certain exemplary embodiments are shown in the figures and described in the above disclosure, it is to be distinctly understood that the presently disclosed inventive concepts are not limited thereto but may be variously embodied to practice within the scope of this disclosure. From the foregoing description, it will be apparent to one skilled in the art that various changes may be made without departing from the spirit and scope of the disclosure as defined herein. Also, various presently unforeseen or unanticipated alternatives, modifications, variations or improvements therein may be subsequently made by those skilled in the art which are also intended to be encompassed by the following claims.

The invention claimed is:

1. A weight support apparatus for attachment to an archery bow, the apparatus comprising:

a. a base comprising two wings, said wings extending laterally away from a centerline of the base;

b. two or more arms comprising:

i. a shoe;

ii. a shoe slot arranged in the middle of said shoe;

iii. a lug portion arranged perpendicular to the shoe and extending out and way from a medial face of the shoe, and iv. one or more bolt holes arranged in the middle of said lug portion;

wherein, the two or more arms are joined by a through bolt extending through the one or more bolt holes;

c. a base channel configured to receive the shoes of said arms; and d. a channel slot arranged at the bottom of the base channel configured to join the two or more arms to the base, wherein, the arms are positioned opposing one another in the channel slot and are slidably attached to the base by a through bolt extending through the shoe slot and channel slot.

2. The apparatus of claim 1 wherein the channel slots are elongated holes such that the distance between the arms is configurable to the size of a bow.

3. The apparatus of claim 1 wherein the through bolt holes comprise a bolt and hex nut.

4. The apparatus of claim 1 wherein the through bolt is a threaded bolt configured to rotatably attach to a complementary bolt hole.

5. The apparatus of claim 3 wherein the bolt and hex nut are formed from a polymer.

6. The apparatus of claim 1 wherein the base and arms are manufactured from a rigid material selected from a group consisting of plastic and metal.

7. The apparatus of claim 1 wherein the wings are formed in an arcuate shape.

8. The apparatus of claim 1 further comprising a grip region located near the outer edge of the wings.

9. The apparatus of claim 8 wherein the grip region is formed from silicone.

10. A method for attaching a weight support apparatus to a bow, the method comprising the steps of:

a. providing a bow;

b. attaching two or more arms to a base of the weight support apparatus by guiding one or more shoes of the arms into a channel;

c. sliding the shoes along the length of the channel to reach a desired width;

d. fastening the arms by inserting a shoe bolt into a shoe hole and through a channel slot;

e. attaching the weight support apparatus to the bow by inserting the bow between the arms;

f. positioning the bow to abut against an attachment point;

g. inserting a through bolt through one or more bolt holes on each of the arms; and h. tightening the through bolt.

11. The method of claim 10 further comprising the step of slidably adjusting the through bolt along the length of an elongated bolt hole to accommodate varying bow sizes.

12. The method of claim 10 further comprising the step of resting a wing of the weight support apparatus on a supporting structure.

* * * * *